United States Patent [19]

Barlow

[11] Patent Number: 4,936,579

[45] Date of Patent: Jun. 26, 1990

[54] TABLETOP BASEBALL GAME

[75] Inventor: Gordon A. Barlow, Highland Park, Ill.

[73] Assignee: Gordon Barlow Design, Skokie, Ill.

[21] Appl. No.: 345,764

[22] Filed: May 1, 1989

[51] Int. Cl.[5] ..... A63F 7/06

[52] U.S. Cl. ..... 273/89; 273/129 V

[58] Field of Search ..... 273/88–90, 273/129 V, 129 W, 121 D, 8, 9; 124/16, 17

[56] References Cited

U.S. PATENT DOCUMENTS

| | | | |
|---|---|---|---|
| 2,631,854 | 3/1953 | Volman | 273/90 |
| 3,069,166 | 12/1962 | Lindman | 273/89 |
| 3,358,997 | 12/1967 | Belz | 273/89 |
| 3,534,962 | 10/1970 | Singleman | 273/90 |
| 3,985,358 | 10/1976 | Hamano | 273/89 |
| 4,105,207 | 8/1978 | Cooper et al. | 273/89 |
| 4,179,123 | 12/1979 | Tsukuda | 273/89 |
| 4,260,153 | 4/1981 | Nishimiya | 273/89 |
| 4,327,913 | 5/1982 | Bock | 273/89 |

*Primary Examiner*—Edward M. Coven
*Assistant Examiner*—Sebastiano Passaniti
*Attorney, Agent, or Firm*—Kinzer, Plyer, Dorn, McEachran & Jambor

[57] ABSTRACT

A tabletop baseball game including a replica of a baseball field and a diamond which is constructed with plastic tubing and bases joined by connectors. A ball-hitting mechanism and a ball-positioning and supporting wall are provided as part of home plate. The ball-hitting mechanism includes an arm which is pivotally mounted for rotation in an arc relative to home plate. A replica of a baseball bat is pivotally mounted on the arm for swinging motion in a path that intersects the ball when it is positioned on the home plate. A spring mechanism is provided which can be tensioned by reverse rotation of the bat replica, stored by a ratchet and pawl mechanism and released by a push button to swing the bat.

3 Claims, 3 Drawing Sheets

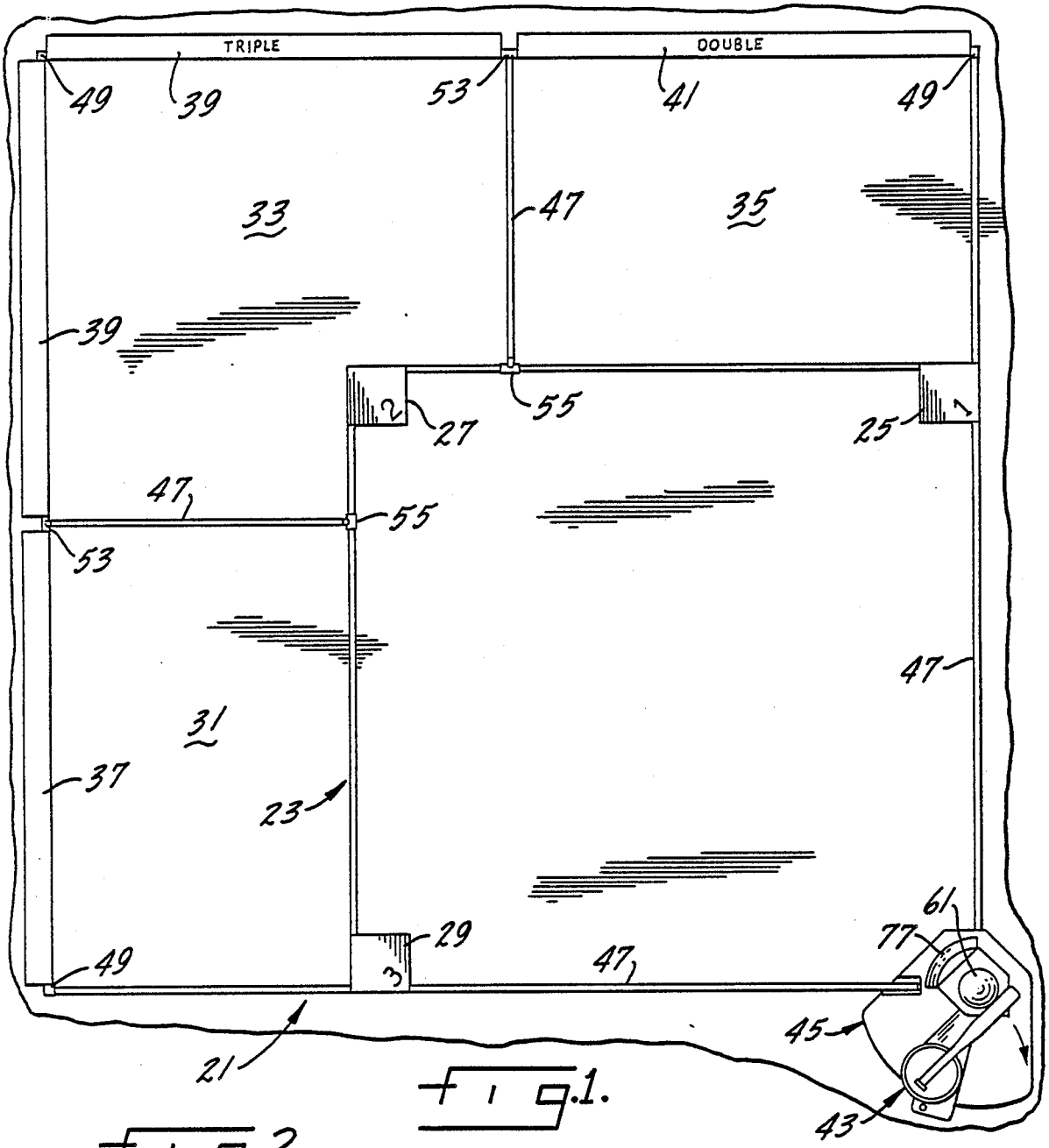
Fig. 1.
Fig. 2.
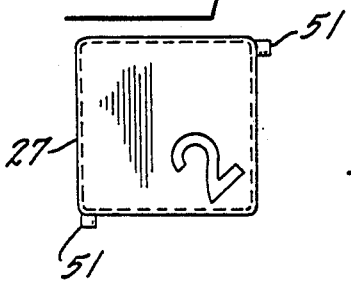
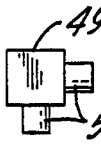
Fig. 3.
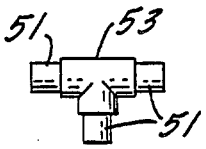
Fig. 4.
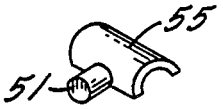
Fig. 5.
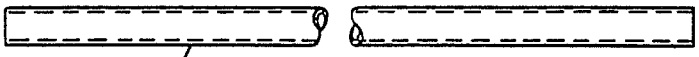
Fig. 6.

TABLETOP BASEBALL GAME

BACKGROUND AND SUMMARY OF THE INVENTION

This invention is directed to a simulated baseball game which can be played on a tabletop or on a floor indoors. It is suitable for use by any age of players, ranging from children to adults, and the number of players on each team is not limited, except by the traditional concept that each baseball team should have not more than nine players.

The playing field, although relatively large in area, can be stored in a small game box and is easily assembled on a suitable tabletop or floor without requiring any special tools. Replicas of players may also be provided, but they are not necessary for playing the game. An essential part of the game is a ball-hitting mechanism which is a substitute for a batter. The preferable type of ball is a table tennis ball, although the game can be designed for use with practically any type of small, resilient ball.

An object of this invention is a tabletop game which simulates a baseball game.

Another object of this invention is a simulated baseball game having a replica of a baseball field which can be stored in a game box and readily assembled into a baseball playing field with a diamond, bases and an outfield.

Another object of this game is a simulated baseball game in which the ball-hitting mechanism can be rotated so that the player can select the field to which to try to hit the ball.

Another object of this invention is a simulated baseball game in which the player can adjust the ball-hitting mechanism to determine how hard to hit the ball.

Other objects of this invention will be found in the following specification, claims and drawings.

BRIEF DESCRIPTION OF THE DRAWINGS

The invention is illustrated more or less diagrammatically in the following drawings wherein:

FIG. 1 is a top plan view of the tabletop simulated baseball game of this invention;

FIG. 2 is an enlarged, top plan view of one of the bases shown in FIG. 1;

FIG. 3 is an enlarged plan view of a right angle connector for tubing used to form the replica of a baseball field shown in FIG. 1;

FIG. 4 is an enlarged, top plan view of a three-way T-type connector, which is used in the same manner as the connector of FIG. 3;

FIG. 5 is an enlarged, top plan view of yet another form of connector used in constructing the replica of a baseball field shown in FIG. 1;

FIG. 6 is an enlarged, plan view of a piece of tubing used in constructing the replica of the baseball field;

DESCRIPTION OF THE PREFERRED EMBODIMENT

Figure 7:
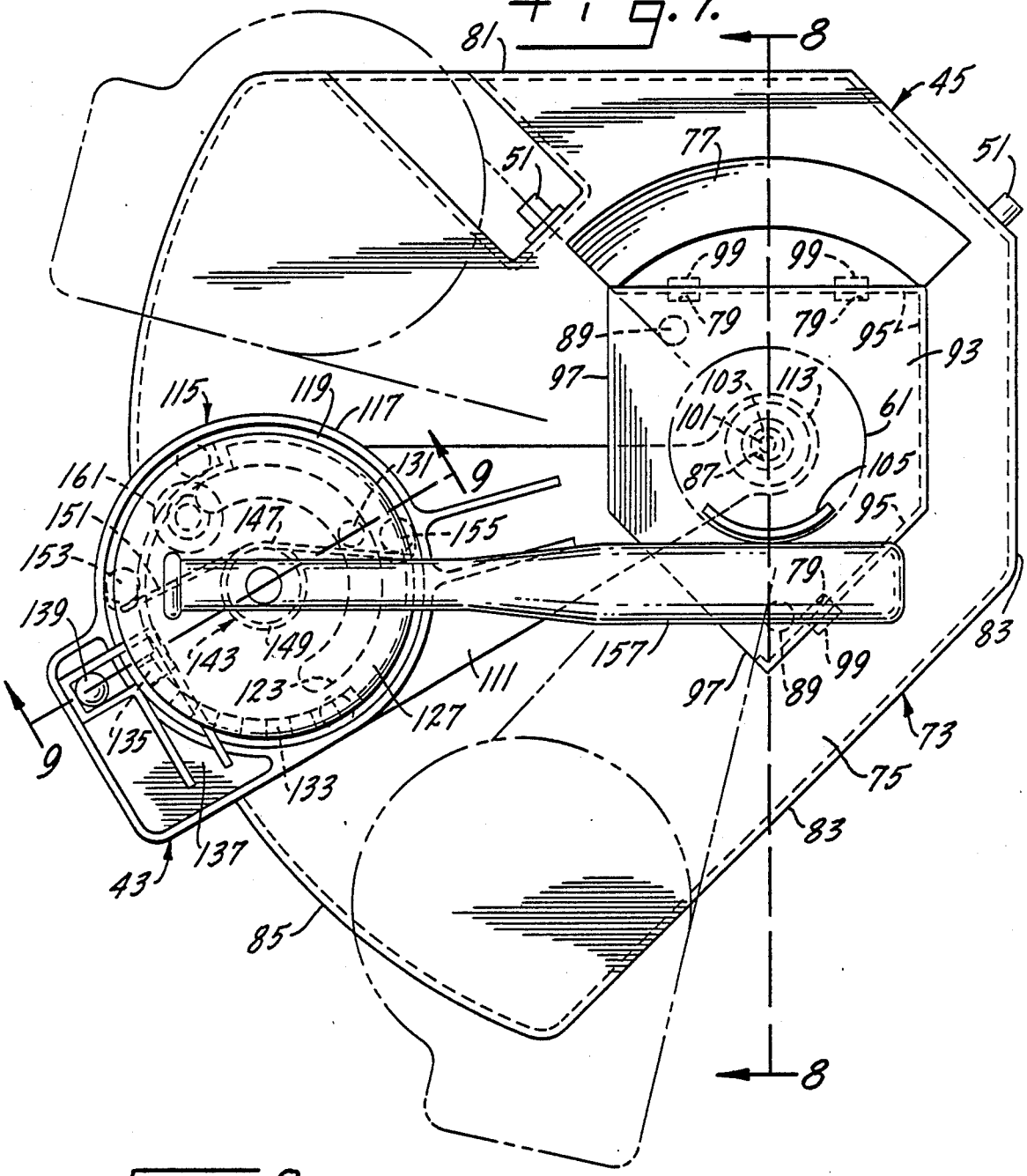
FIG. 7 is an enlarged, top plan view of the home plate and ball-hitting mechanism of this invention, showing rotated positions of the ball-hitting mechanism in phantom lines and hidden parts in dashed lines.

FIG. 1 of the drawings shows a replica 21 of a baseball field having a diamond 23, a first base 25, second base 27, third base 29, left field 31, center field 33, right field 35, a left field fence 37, a center field fence 39, a right field fence 41, and a ball-hitting mechanism 43 mounted on a home plate assembly 45. The aforementioned bases and fences are connected by lengths of plastic tubing 47 to provide the replica 21 of a baseball field. The lengths of plastic tubing 47 are connected by right angle connectors 49 of the type shown in FIG. 3, cylindrical stubs 51 of the type shown on second base 27 (shown in enlarged detail in FIG. 2) and T-connectors 53 of the type shown in FIG. 4. Additionally, split sleeve intermediate connectors 55 of the type shown in FIG. 5 connect the lengths of tubing 47 which divide the outfields into right center and left field and fit over the lengths of plastic tubing 47 extending between first and second base and second and third base, respectively. Each connector has one or more cylindrical stubs 51 which are received in the openings in the ends of the tubing 47.

A ball 61, which preferably is the size and weight of a table tennis ball, is used as the baseball. It should be understood and appreciated that other types and different sizes of balls may be used, depending on the size of the baseball field replica. Suitable balls include sponge balls, rubber balls, blow-molded balls, and what are referred to as "WHIFFLE" balls.

The ball-hitting mechanism 43, shown in detail in FIGS. 7–14 of the drawings, is mounted on a support platform 73 of home plate assembly 45. The support platform has a generally flat top surface 75 in which is integrally formed an arcuate lofting ramp 77 for the ball 61. Three slots 79 are formed in the top surface 75 to receive a home plate. The support platform 73 also includes a front, downwardly-extending peripheral wall 81, inclined side peripheral walls 83, and a rear, short arcuate wall 85. Also formed in the top surface 75 is a center opening 87 for the ball-hitting arm pivot. A pair of upstanding cylindrical stops 89 are located on the top surface 75 between two of the slots 79.

A replica 93 of a home plate having five side walls is mounted on the support platform 73 on the top surface 75 of the support platform 73. The home plate has three downwardly-extending peripheral walls 95 and two open walls 97. Three downwardly-extending snap fasteners 99 (FIG. 8) extend from the peripheral walls 95 into the slots 79 to secure the home plate in position. A downwardly-extending post 101 is formed integrally with the home plate and it is received in a flanged sleeve 103 which extends through the center opening 87 of the support platform 73 to function as a pivot for a ball-hitting mechanism arm to be hereinafter described. An arcuate-shaped ball support wall 105 is formed integrally with the home plate and is aligned with the lofting ramp 77 formed on the support platform 73.

Figure 8:
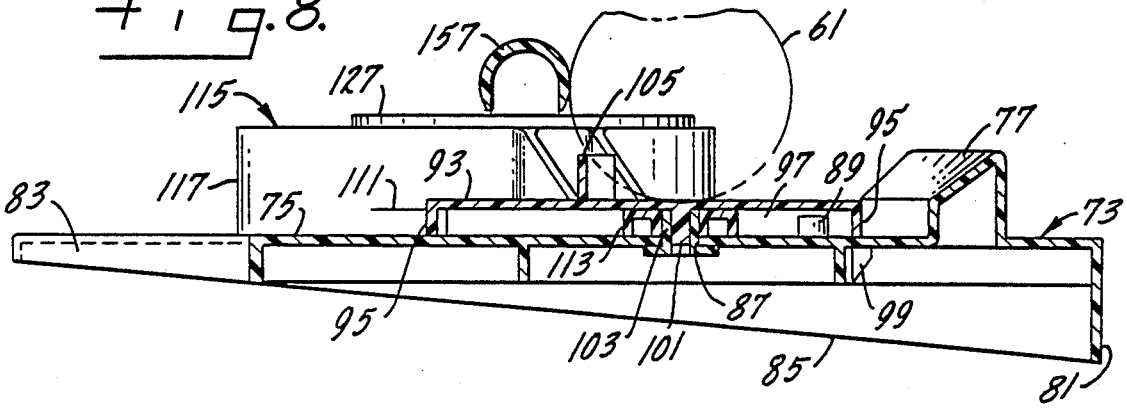
FIG. 8 is a cross-sectional view taken along line 8—8 of FIG. 7.

A plastic ball-hitting mechanism arm 111 is formed with an eye 113 at one end thereof which receives the flanged sleeve 103 to pivotally mount the arm relative to home plate 93, with the arm extending through the open walls 97 of home plate for arcuate movement between the upstanding stops 89 which are positioned under home plate, as most clearly shown in FIGS. 7 and 8 of the drawings. Formed integrally on the arm outwardly of home plate is a cylindrical housing 115 having an upstanding, circular peripheral wall 117 and a recessed top wall 119. A central opening 121 is formed in the recessed top wall 119 and an arcuate slot 123 is formed in the recessed top wall to partially surround the center opening 121.

A removable cover 127 is provided for the cylindrical housing 115. The cover has an integrally-formed, downwardly-extending center pivot post 129 and an eccentrically-located, downwardly-extending post 131 which rides in the arcuate slot 123 of the recessed top wall 119 of the housing 115, as most clearly shown in FIGS. 7 and 9 of the drawings. As can be most clearly seen in FIGS. 7, 12, 13 and 14 of the drawings, ratchet teeth 133 are formed on a portion of the lower periphery of the cover 127. A pawl 135, as most clearly shown in FIGS. 7, 10 and 11 of the drawings, is formed on an L-shaped, flexible lever 137 formed in the recessed top wall 119 of the cylindrical housing 115. An upstanding button 139 is attached to the free end of the L-shaped lever 137 for use in depressing the lever and pawl 135. The button is most clearly shown in FIGS. 7, 9 and 11 of the drawings.

Figure 9:
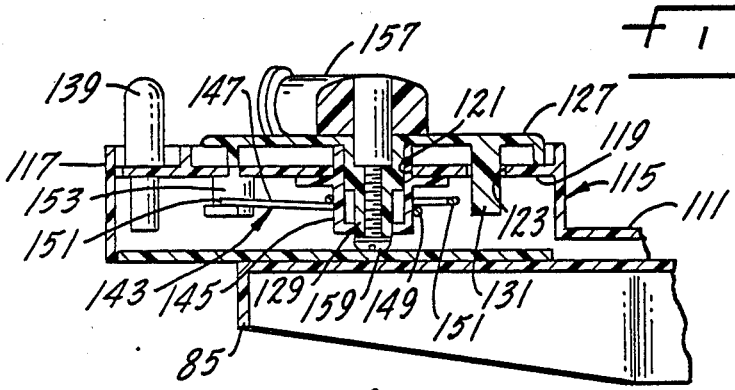
FIG. 9 is a partial view taken along line 9—9 of FIG. 7.
Figure 10:
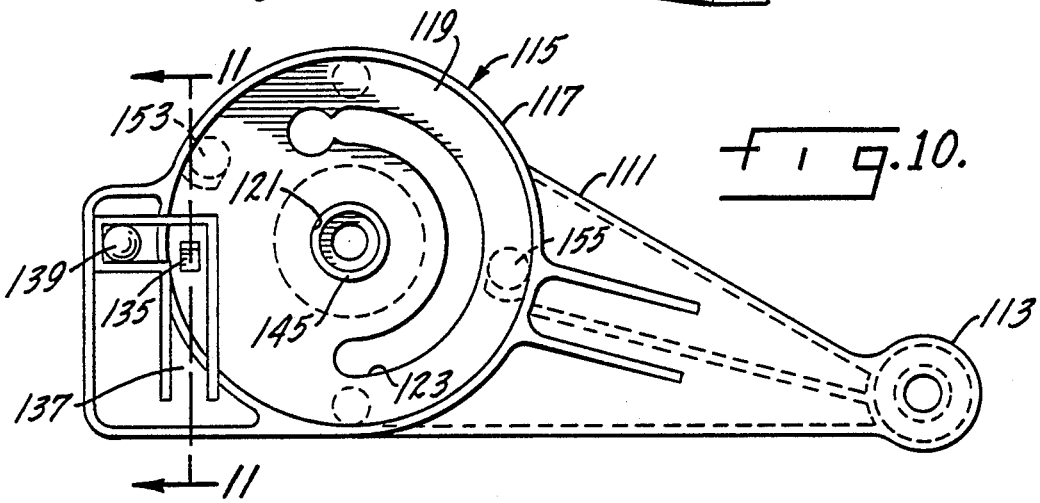
FIG. 10 is a enlarged, top plan view of a portion of the ball-hitting mechanism, with parts removed for clarity of illustration.
Figure 11:
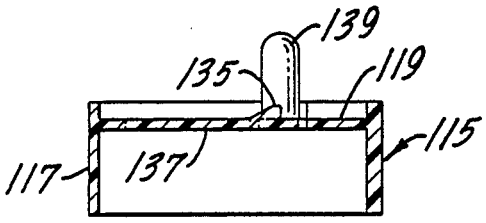
FIG. 11 is a view taken along line 11—11 of FIG. 10.
Figure 12:
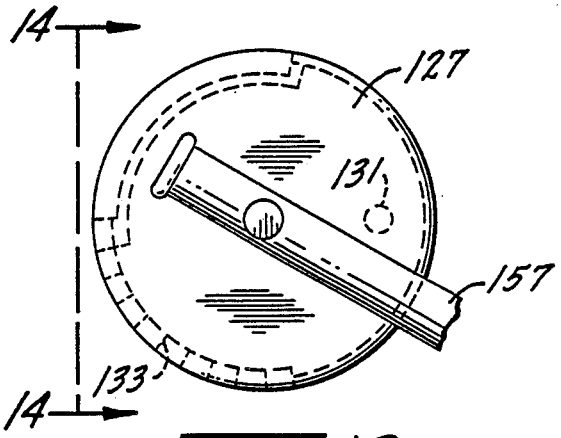
FIG. 12 is an enlarged, top plan view of a portion of the ball-hitting mechanism, with parts broken away.
Figure 13:
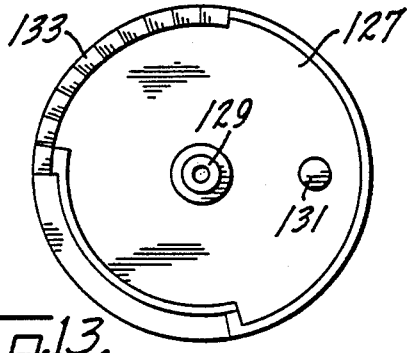
FIG. 13 is a bottom view of the mechanism of FIG. 12, with parts omitted.
Figure 14:
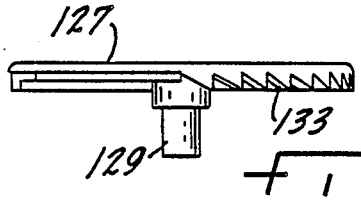
FIG. 14 is a view taken along line 14-14 of FIG. 12, with the bat replica omitted.

A spring drive mechanism 143, shown most clearly in FIGS. 7 and 9 of the drawings, is positioned in the cylindrical housing 115 to rapidly rotate the cover 127. It includes an inverted flanged sleeve 145 which receives the pivot post 129 of the cover and fits in the center opening 121 of the recessed top wall 119 of the cover. A spring 147 forms a coil 149 around the sleeve 145, and the ends 151 of the spring, as most clearly shown in FIG. 7 of the drawings, are anchored at L-shaped brackets 153 and 155, formed integrally with the underside of the recessed top wall 119 of the cylindrical housing. A replica 157 of a bat is mounted on top of the cover 127 of the housing, and the assembly is held together by a screw 159, shown in FIG. 9 of the drawings. A cushioned stop 161 is located at one end of the arcuate slot 123 to engage the downwardly-extending cover post 131 to limit rotation of the cover 127.

The use, operation and function of this invention are as follows. The tabletop baseball game of my invention can easily be stored in a game box and set up on a large table or floor. Assembly is relatively simple, using the lengths of plastic tubing 47 in conjunction with the bases 25, 27 and 29 and the outfield fences 37, 39 and 41. The tubing 47 is connected to the bases and to the outfield fences and ball-hitting mechanism 43 by connecting the tubing to the stubs 51, which are found on these items as well as on the right angle connectors 49, T-connectors 53 and split sleeve intermediate connectors 55. Seven plastic fielders, each representing a member of a baseball game other than the pitcher and catcher, may also be provided; however, these are not shown in the drawings for clarity of illustration. As shown in FIG. 1 of the drawings, the outfield fences may be labeled to indicate the value obtained by the batter by hitting the ball into a particular field, such as the word "double" shown on the right field fence 41 and the word "triple" shown on the center field fence 39. Of course, a home run can be scored by hitting the ball over any of the outfield fences. Conversely, if the batted ball hits one of the players positioned on the field, it is an out.

In playing the game, each player takes his position at the ball-hitting mechanism 43 by placing the ball 61 against the arcuate ball support wall 105. The ball-hitting mechanism tilts upwardly in the direction of the baseball field in order to provide loft to the batted ball. The player can then move the ball-hitting mechanism arm 111 by rotating it to attempt to hit the ball to right center or left field. The arm 111 is movable in an arc between the stops 89, shown in FIG. 7 of the drawings. The batter can also determine how hard to hit the ball by rotating the bat replica 157 in a clockwise direction, as shown in FIGS. 1 and 7 of the drawings, as far as desired. Clockwise rotation of the bat will move the post 131 into contact with an end 151 of the coil spring to energize the coil spring. The ratchet teeth 133 on the undersurface of the cover 127 will ride over the pawl 135 to retain the bat replica in the desired charged position. When the batter is ready to hit the ball, all that is necessary is to depress the upstanding button 139, which will release the pawl 135 from engagement with the ratchet teeth 133 and allow the bat replica to swing rapidly in a counterclockwise direction, as viewed in FIGS. 1 and 7 of the drawings, to strike the ball 61 and propel it from home plate. As the ball 61 leaves home plate, it will strike the lofting ramp 77, bouncing it up into the air so that it can clear the players positioned on the field and land in one of the designated areas, indicating a hit or a home run.

The advantage of this game is that it can be played in accordance with the well understood rules of baseball by as many or as few players as are available. Each batter can demonstrate his skill by his aiming of his hit and the amount of power that he wishes to put into the batted ball.

I claim:

1. A tabletop baseball game including:

means defining a replica of a baseball field, including a diamond having first, second and third bases and left, center and right playing fields, and a ball-hitting mechanism, said mechanism including:

means defining a replica of a home plate with a ball-positioning and supporting wall, an arm pivotally mounted for rotation in an arc relative to said replica of a home plate, a baseball bat replica pivotally mounted on said arm at a location on one side of said replica of a home plate for swinging motion in a path that intersects a vertical plane containing said ball-positioning and supporting wall at any position of rotation of said arm, and means to rapidly swing said bat replica in said path to hit a ball located on said ball-positioning and supporting wall with said bat replica and to propel said ball away from said wall and onto said replica of a baseball field, said means defining a replica of a baseball field including lengths of plastic tubing for defining base lines, foul lines and the outfield boundaries, base replicas, outfield fence replicas and connectors for joining said lengths of tubing to said base replicas, said outfield fence replicas, and said ball-hitting mechanism.

2. The tabletop baseball game of claim 1 in which said baseball-hitting mechanism further includes:

a support platform, means formed on said support platform to connect said platform to said lengths of plastic tubing defining the first and third base lines, means formed on said home plate and said support platform to fasten said home plate to said platform in alignment with said replica of said baseball field, said pivot means for said arm being formed by said support platform and said home plate and located under said home plate, stop means formed under said home plate to limit rotation of said arm, and a lofting ramp for said ball formed on said support platform in front of said home plate.

3. The tabletop baseball game of claim 1 in which said means to rapidly swing said bat replica in said path includes:

a housing formed as part of said arm and having a cover rotatably mounted thereon, said bat replica being affixed to said cover and extending outwardly beyond said housing, spring means located in said housing and engaging said cover so that rotation of said cover in one direction charges said spring and the release of said charged spring rapidly rotates said cover and bat replica in the opposite direction, a ratchet and pawl means formed on said cover and said housing to retain said cover in various rotational positions in which said spring is charged, and means to release said charged spring to rotate said cover and bat replica to hit said ball.

* * * * *